US012760615B2

(12) United States Patent
Dow et al.

(10) Patent No.: US 12,760,615 B2
(45) Date of Patent: Oct. 13, 2026

(54) INTEGRATED RISER JOINT, COMPONENT ORIENTATION AND APPLICATION WITHIN THE RISER STRING, INCLUDING SEABED

(71) Applicant: Schlumberger Technology Corporation, Sugar Land, TX (US)

(72) Inventors: Blaine Dow, Sugar Land, TX (US); Bastiaan Liezenberg, Sugar Land, TX (US); Matthew David Givens, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 19/139,344

(22) PCT Filed: Jan. 12, 2024

(86) PCT No.: PCT/US2024/011321
§ 371 (c)(1),
(2) Date: Jun. 15, 2025

(87) PCT Pub. No.: WO2024/151900
PCT Pub. Date: Jul. 18, 2024

(65) Prior Publication Data

US 2026/0201769 A1 Jul. 16, 2026

Related U.S. Application Data

(60) Provisional application No. 63/479,849, filed on Jan. 13, 2023.

(51) Int. Cl.
*E21B 33/08* (2006.01)
*E21B 33/038* (2006.01)

(52) U.S. Cl.
CPC ..... *E21B 33/085* (2013.01); *E21B 33/038* (2013.01)

(58) Field of Classification Search
CPC ..... E21B 17/01; E21B 33/035; E21B 33/038; E21B 33/064; E21B 33/085
See application file for complete search history.

(56) References Cited

U.S. PATENT DOCUMENTS 6,367,554 B1 4/2002 Theiss
8,347,982 B2 * 1/2013 Hannegan ..... E21B 33/085 166/347

(Continued)

FOREIGN PATENT DOCUMENTS

EP 3874119 B1 * 8/2023 ..... E21B 17/01
EP 3867490 B1 * 1/2024 ..... E21B 17/01

(Continued)

OTHER PUBLICATIONS

"Deepwater Integrated MPD Riser Joint", Retrieved from the internet: https://www.slb.com/products-and-services/innovating-in-oil-and-gas/well-construction/rigs-and-equipment/managed-pressure-drilling-equipment/deepwater-integrated-mpd-riser-joint, Jan. 10, 2023, pp. 1-6.

*Primary Examiner* — Jennifer H Gay
(74) *Attorney, Agent, or Firm* — Jeffrey D. Frantz

(57) ABSTRACT

An integrated riser joint includes a first annular blower preventer configured to couple to a first riser section, a first rotating control device coupled to the first annular blowout preventer, and a flow spool fluidly coupled to the first rotating control device. The first annular blowout preventer, the first rotating control device, and the flow spool are arranged in a downward order.

20 Claims, 2 Drawing Sheets

(56) References Cited

U.S. PATENT DOCUMENTS

| | | | | |
|---|---|---|---|---|
| 9,109,420 | B2 * | 8/2015 | Tindle | E21B 33/035 |
| 10,012,044 | B2 * | 7/2018 | Leba | E21B 17/0853 |
| 10,072,475 | B2 | 9/2018 | Liezenberg | |
| 10,280,743 | B2 * | 5/2019 | Khan | E21B 47/06 |
| 10,294,746 | B2 * | 5/2019 | Gilmore | E21B 17/006 |
| 10,435,980 | B2 * | 10/2019 | Grace | E21B 33/064 |
| 10,648,315 | B2 | 5/2020 | Couturier | |
| 11,105,171 | B2 * | 8/2021 | Fraczek | E21B 33/085 |
| 11,136,841 | B2 * | 10/2021 | Santos | E21B 21/08 |
| 11,332,998 | B2 * | 5/2022 | Johnson | E21B 33/1208 |
| 11,377,922 | B2 * | 7/2022 | Johnson | E21B 17/01 |
| 11,629,559 | B2 * | 4/2023 | Ziegler | E21B 34/066 166/380 |
| 11,982,134 | B2 * | 5/2024 | Tenorio | E21B 17/0853 |
| 2010/0175882 | A1 * | 7/2010 | Bailey | E21B 33/085 166/387 |
| 2012/0000664 | A1 * | 1/2012 | Nas | E21B 33/0387 166/344 |
| 2012/0168171 | A1 * | 7/2012 | Varpe | E21B 34/04 166/363 |
| 2014/0027129 | A1 | 1/2014 | Hannegan | |
| 2014/0209316 | A1 * | 7/2014 | Tindle | E21B 7/12 166/345 |
| 2014/0262313 | A1 * | 9/2014 | Gilmore | E21B 33/035 166/363 |
| 2016/0138352 | A1 * | 5/2016 | Leba | E21B 33/085 166/377 |
| 2017/0191333 | A1 * | 7/2017 | Lewis | E21B 33/035 |
| 2018/0245411 | A1 * | 8/2018 | Piccolo | E21B 33/0355 |
| 2018/0258730 | A1 * | 9/2018 | Grace | E21B 33/038 |
| 2018/0274362 | A1 * | 9/2018 | Khan | E21B 33/085 |
| 2019/0055791 | A1 * | 2/2019 | Barela | E21B 17/006 |
| 2020/0270953 | A1 * | 8/2020 | Ziegler | E21B 33/038 |
| 2020/0270955 | A1 * | 8/2020 | Ziegler | E21B 21/08 |
| 2021/0246755 | A1 * | 8/2021 | Johnson | E21B 17/085 |
| 2021/0348461 | A1 | 11/2021 | Teixeira | |
| 2023/0265725 | A1 * | 8/2023 | Tenorio | E21B 17/0853 166/364 |

FOREIGN PATENT DOCUMENTS

| | | | | |
|---|---|---|---|---|
| FR | 2952399 | A1 * | 5/2011 | E21B 17/01 |
| WO | 2022051278 | A1 | 3/2022 | |
| WO | WO-2024151900 | A1 * | 7/2024 | E21B 33/085 |

* cited by examiner

INTEGRATED RISER JOINT, COMPONENT ORIENTATION AND APPLICATION WITHIN THE RISER STRING, INCLUDING SEABED

CROSS-REFERENCE TO RELATED APPLICATION

The present document is a National Stage Entry of International Application No. PCT/US2024/011321, filed Jan. 12, 2024, which is based on and claims priority to U.S. Provisional Patent Application No. 63/479849, filed Jan. 13, 2023, which is incorporated herein by reference in its entirety.

BACKGROUND

Managed pressure drilling ("MPD") wellbores through subsurface formations includes the use of a rotating control device ("RCD") at a selected position above the top of the wellbore. The RCD includes a bearing and seal assembly that enables rotation of a drill string, and longitudinal motion of a drill string as the wellbore is drilled, while maintaining a fluid-tight seal between the drill string and the wellbore so that drilling fluid discharged from the wellbore may be discharged in a controlled manner.

Drilling, production, and completion of offshore wells from a floating platform, e.g., a vessel, tension leg platform, etc. is conducted through a riser assembly extending from the platform to the wellhead on the sea floor. The riser assembly includes a series of pipe sections connected end to end. Marine drilling risers provide a conduit through which materials may flow between the platform and the wellbore.

SUMMARY

According to one or more embodiments of the present disclosure, an integrated riser joint includes a first annular blowout preventer configured to coupled to a first riser section, a first rotating control device coupled to the first annular blowout preventer, and a flow spool fluidly coupled to the first rotating control device. According to one or more embodiments of the present disclosure, the first annular blowout preventer, the first rotating control device, and the flow spool are arranged in a downward order.

A method according to one or more embodiments of the present disclosure includes coupling a first annular blowout preventer to a first riser section, coupling a first rotating control device to the first annular blowout preventer, and fluidly coupling a flow spool to the first rotating control device, wherein the first annular blowout preventer, the first rotating control device, and the flow spool are arranged in a downward order.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein.

DETAILED DESCRIPTION

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

In the specification and appended claims, the terms "connect," "connection," "connected," "in connection with," and "connecting," are used to mean "in direct connection with," in connection with via one or more elements." The terms "couple," "coupled," "coupled with," "coupled together," and "coupling" are used to mean "directly coupled together," or "coupled together via one or more elements." The term "set" is used to mean setting "one element" or "more than one element." As used herein, the terms "up" and "down," "upper" and "lower," "upwardly" and "downwardly," "upstream" and "downstream," "uphole" and "downhole," "above" and "below," "top" and "bottom," and other like terms indicating relative positions above or below a given point or element are used in this description to more clearly describe some embodiments of the disclosure. Commonly, these terms relate to a reference point at the surface from which drilling operations are initiated as being the top point and the total depth being the lowest point, wherein the well (e.g., wellbore, borehole) is vertical, horizontal, or slanted relative to the surface.

In general, embodiments of the present disclosure relate to MPD and/or pressure and fluid containment operations. More specifically, embodiments of the present disclosure relate to a deepwater integrated riser joint for MPD and/or pressure and fluid containment operations.

An integrated riser joint for MPD and/or pressure and fluid containment operations may include a riser gas handling ("RGH") system, such as that developed by Cameron (a Schlumberger company), and a below-tension-ring rotating control device ("BTR RCD"), such as that developed by M-I SWACO (a Schlumberger company), disposed at a selected position along the length of the marine drilling riser. The RGH system includes a riser-mounted annular BOP and a flow spool, for example. The integrated MPD riser joint shown and described in U.S. Pat. No. 10,072,475, granted Sep. 11, 2018, is incorporated by reference herein in its entirety.

Figure 1A:
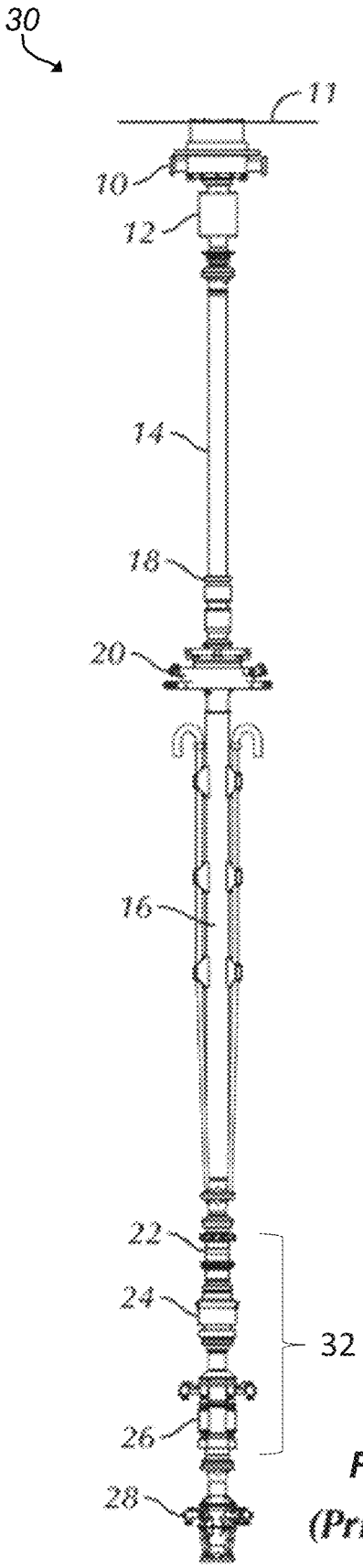
FIG. 1A (Prior Art)
FIG. 1A shows an example of a conventional marine system for MPD and/or pressure and fluid containment operations.

Referring now to FIG. 1A, an example of a conventional marine system 30 for MPD and/or pressure and fluid containment operations is shown. As shown in FIG. 1A, the conventional marine system 30 includes an outer barrel 16 (i.e., first riser section) of a telescoping rise section coupled to the top of a fixed length of riser (not shown) that extends to a subsea wellhead (not shown). The telescoping riser section is supported by a tension ring 20 coupled to the outer barrel 16. The tension ring 20 is a type of buoyancy component for supporting at least part of the weight of the riser in a body of water. The tension ring 20 includes cables (not shown) that extend to the floating drilling platform 11 in order to transfer some of the buoyancy thereof to the tension ring 20 to support at least part of the weight of the riser in the body of water. An inner barrel 14 (i.e., second riser section) slidably, sealingly engages the interior of the outer barrel 16. A flex joint 12 and a diverter 10 are disposed at the top of the inner barrel 14. Thus, the length of the riser is able to be changed in order to compensate for heave of the drilling platform 11. The riser is also able to be moved laterally to compensate for lateral motion of the drilling platform 11. The tension ring 20 is disposed at a selected distance below the top 18 of the outer barrel 16.

Still referring to FIG. 1A, the conventional marine system 30 includes an RCD 22, an annular blowout preventer ("BOP") 24, and a flow spool 26 coupled to the bottom of the outer barrel 16, thus below the tension ring 20, which is affixed to the outer barrel 16 as previously explained. In this way, the RCD 22, the annular BOP 24, and the flow spool 26 form an integrated riser joint 32 of the conventional marine system 30, for example. The flow spool 26 is disposed below the annular BOP 24 to provide a flow path for drilling fluid exiting the well where a flow path in the riser above the RCD 22 is sealed by the RCD 22 when a drill string (not shown) is inserted therein. The conventional marine system 30 also includes a termination joint 28 disposed below the flow spool, as shown in FIG. 1A, for example.

Figure 1B:
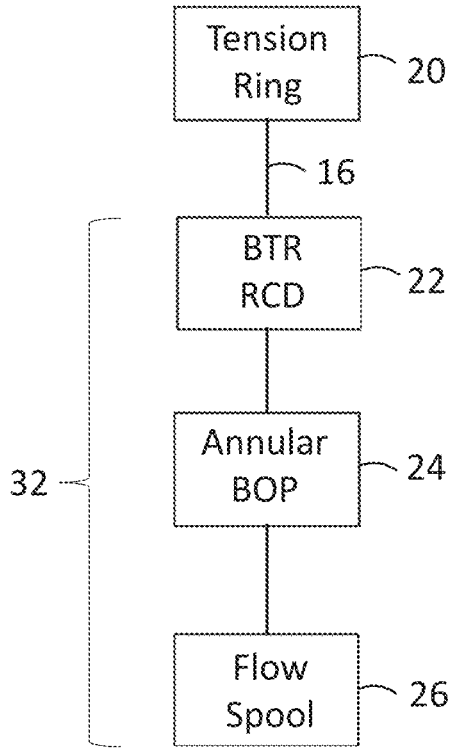
FIG. 1B shows a block schematic including an integrated riser joint of the conventional marine system shown in FIG. 1A.

Referring now to FIG. 1B, a block schematic including the integrated riser joint 32 of the conventional marine system 30 shown in FIG. 1A is shown. That is, FIG. 1B simplifies the conventional marine system 30 shown in FIG. 1A by showing the following key components, including the integrated riser joint 32, arranged in the following downward order: tension ring 20, outer barrel (or first riser section) 16, BTR RCD 22, annular BOP 24, and flow spool 26.

Figure 2:
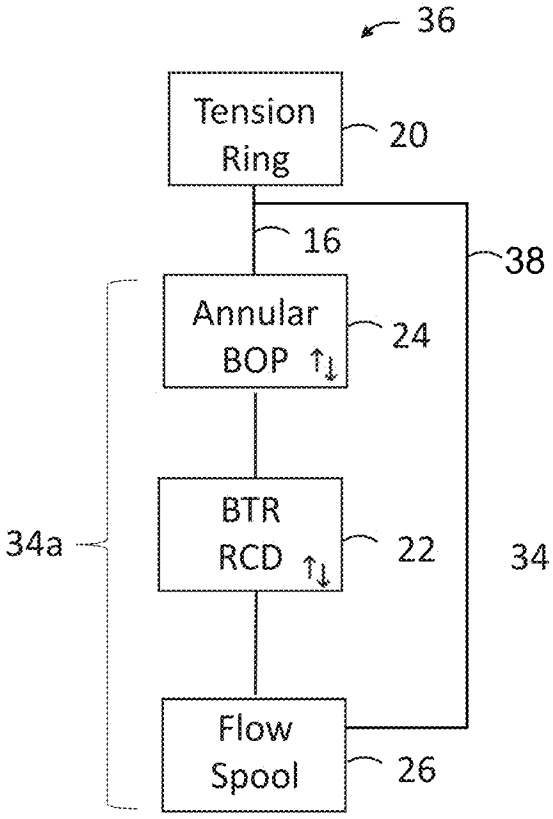
FIG. 2 shows a block schematic including an integrated riser joint of a marine system for MDP and/or pressure and fluid containment operations according to one or more embodiments of the present disclosure.

Referring now to FIG. 2, a block schematic including an integrated riser joint 34*a* of a marine system 36 for MPD and/or pressure and fluid containment operations according to one or more embodiments of the present disclosure is shown. Similar to FIG. 1B, FIG. 2 shows a first riser section 16 coupled to a tension ring 20, and an integrated riser joint 34*a* coupled to the first riser section 16 below the tension ring 20. In contrast to FIG. 1B, however, FIG. 2 implements a different configuration and orientation of the integrated riser joint 34*a*. For example, the integrated riser joint 34*a* according to one or more embodiments of the present disclosure includes a first annular BOP 24 coupled to the first riser section 16, a first BTR RCD 22 coupled to the first annular BOP 24, and a flow spool 26 fluidly coupled to the first BTR RCD 22. As shown in FIG. 2, for example, the first annular BOP 24, the first BTR RCD 22, and the flow spool 26 are arranged in a downward order in the integrated riser joint 34*a* according to one or more embodiments of the present disclosure. As also shown in FIG. 2, at least one or both of the first annular BOP 24 and the first BTR RCD 22 are arranged in an upside down configuration (↑↓), according to one or more embodiments of the present disclosure.

Figure 3:
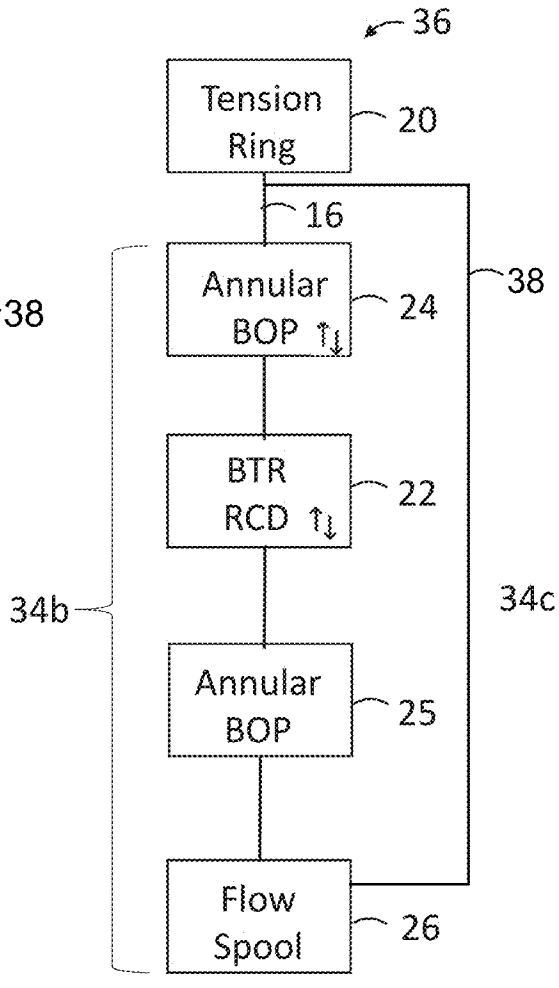
FIG. 3 shows a block schematic of an integrated riser joint of a marine system for MPD and/or pressure and fluid containment operations according to one or more embodiments of the present disclosure.

Referring now to FIG. 3, a block schematic including an integrated riser joint 34*b* of a marine system 36 for MPD and/or pressure and fluid containment operations according to one or more embodiments of the present disclosure is shown. Similar to FIG. 1B and FIG. 2, FIG. 3 shows a first riser section 16 coupled to a tension ring 20, and an integrated riser joint 34*b* coupled to the first riser section 16 below the tension ring 20. Also similar to FIG. 2, FIG. 3 shows that the integrated riser joint 34*b* includes the first annular BOP 24, the first BTR RCD 22, and the flow spool 26 arranged in a downward order, with at least one or both of the first annular BOP 24 and the first BTR RCD 22 being arranged in an upside down configuration, according to one or more embodiments of the present disclosure. In contrast to FIG. 2, however, FIG. 3 implements a different configuration and orientation of the integrated riser joint 34*b*. For example, as shown in FIG. 3, the integrated riser joint 34*b* according to one or more embodiments of the present disclosure includes a second annular BOP 25 coupled between the first BTR RCD 22 and the flow spool 26. According to one or more embodiments of the present disclosure, the second annular BOP 25 may be arranged between the first BTR RCD 22 and the flow spool 26 in a right side up configuration, as shown in FIG. 3, for example.

Figure 4:
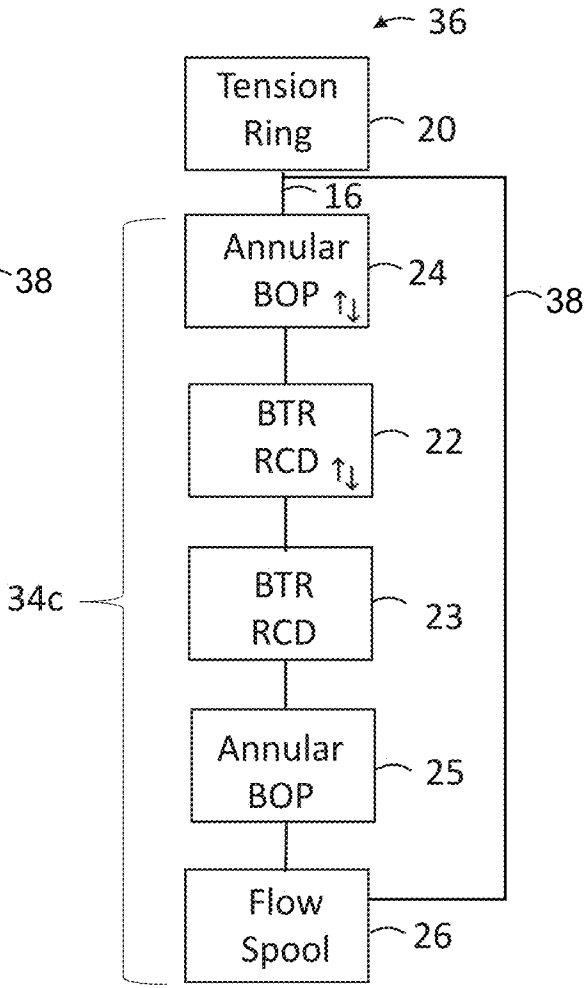
FIG. 4 shows a block schematic of an integrated riser joint of a marine system for MPD and/or pressure and fluid containment operations according to one or more embodiments of the present disclosure.

Referring now to FIG. 4, a block schematic including an integrated riser joint 34*c* of a marine system 36 for MPD and/or pressure and fluid containment operations according to one or more embodiments of the present disclosure is shown. Similar to FIG. 1B and FIG. 2, FIG. 4 shows a first riser section 16 coupled to a tension ring 20, and an integrated riser joint 34*c* coupled to the first riser section 16 below the tension ring 20. Also similar to FIG. 2, FIG. 4 shows that the integrated riser joint 34*c* includes the first annular BOP 24, the first BTR RCD 22, and the flow spool 26 arranged in a downward order, with at least one or both of the first annular BOP 24 and the first BTR RCD 22 being arranged in an upside down configuration, according to one or more embodiments of the present disclosure. In contrast to FIG. 2, however, FIG. 4 implements a different configuration and orientation of the integrated riser joint 34*c*. For example, as shown in FIG. 4, the integrated riser joint 34*c* according to one or more embodiments of the present disclosure includes a second BTR RCD 23 and a second annular BOP 25, arranged in a downward order, coupled between the first BTR RCD 22 and the flow spool 26. According to one or more embodiments of the present disclosure, at least one or both of the second BTR RCD 23 and the second annular BOP 25 may be arranged between the first BTR RCD 22 and the flow spool 26 in a right side up configuration, as shown in FIG. 4, for example.

In view of any of FIGS. 2-4, the marine system 36 for MPD and/or pressure and fluid containment operations according to one or more embodiments of the present disclosure may also include at least one bypass line 38 routed from the flow spool 26 into an annulus of the drilling riser above the first annular BOP 24, for example. Also in view of FIGS. 2-4, while specific examples of integrated riser joints 34*a*, 34*b*, and 34*c* are shown according to one or more embodiments of the present disclosure, it should be understood that other configurations and orientations of the integrated riser joint are possible and are within the scope of the present disclosure.

According to one or more embodiments of the present disclosure, the integrated riser joint may include at least one annular BOP and at least one BTR RCD, each providing pressure and flow sealing from both above and below.

One or more embodiments of the present disclosure provide alternative applications for deploying an integrated riser joint. With minimal configuration changes to the integrated riser joint, which may include reversing the order of the first annular BOP 24 and the first BTR RCD 22 in view of conventional integrated riser joints, arranging at least one or both of the first annular BOP 24 and the first BTR RCD 22 in an upside down configuration, and adding an additional annular BOP 25 and/or BTR RCD 23 above the flow spool 26, as previously described, the integrated riser joint according to one or more embodiments of the present disclosure may be able to be run deeper in the riser (such as to the depth of the seabed) and work to effectively stabilize losses in the riser that may occur when a severe loss reservoir is encountered. Indeed, by inverting the integrated riser joint according to one or more embodiments of the present disclosure, either as a complete unit or component by component (e.g., BTR RCD and annular BOP), or in a duality of one or more of the components configured in any combination of up or down, the integrated riser joint may serve different pressure and fluid retention purposes during MPD and/or pressure and fluid containment operations, for example. Moreover, the different configurations and orientations of the components of the integrated riser joint according to one or more embodiments of the present disclosure may allow sealing from above, which may enhance the performance of the sealed rotating system incorporated in the BTR RCD of the integrated riser joint, for example.

While the disclosure may be susceptible to various modifications and alternative forms, specific embodiments have been shown by way of example in the drawings and have been described in detail herein. However, it should be understood that the disclosure is not intended to be limited to the particular forms disclosed. Rather, the disclosure is to cover all modifications, equivalents, and alternatives falling within the spirit and scope of the disclosure as defined by the following appended claims. Furthermore, numerical terms, such as "first," "second," and "third" are used to distinguish components to facilitate discussion, and it should be appreciated that the numerical terms may be used differently or assigned to different elements in the claims.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. An integrated riser joint comprising:
a first annular blowout preventer configured to couple to a first riser section;
a first rotating control device coupled to the first annular blowout preventer;
a flow spool fluidly coupled to the first rotating control device; and
at least one bypass line routed from the flow spool into an annulus of the first riser section above the first annular blowout preventer,
wherein the first annular blowout preventer, the first rotating control device, and the flow spool are arranged in a downward order.

2. The integrated riser joint of claim 1, wherein at least one of the first annular blowout preventer or the first rotating control device is arranged in an upside down configuration.

3. The integrated riser joint of claim 2, wherein the other of the first annular blowout preventer and the first rotating control device is arranged in the upside down configuration.

4. The integrated riser joint of claim 2, further comprising:
a second annular blowout preventer coupled between the first rotating control device and the flow spool.

5. The integrated riser joint of claim 3, further comprising:
a second annular blowout preventer coupled between the first rotating control device and the flow spool.

6. The integrated riser joint of claim 4, further comprising:
a second rotating control device coupled between the first rotating control device and the second annular blowout preventer.

7. The integrated riser joint of claim 5, further comprising:
a second rotating control device coupled between the first rotating control device and the second annular blowout preventer.

8. A method comprising:
coupling a first annular blowout preventer to a first riser section;
coupling a first rotating control device to the first annular blowout preventer;
fluidly coupling a flow spool to the first rotating control device; and
routing at least one bypass line from the flow spool into an annulus of the first riser section above the first annular blowout preventer,
wherein the first annular blowout preventer, the first rotating control device, and the flow spool are arranged in a downward order.

9. The method of claim 8, wherein at least one of the first annular blowout preventer and the first rotating control device is arranged in an upside down configuration.

10. The method of claim 9, wherein the other of the first annular blowout preventer and the first rotating control device is arranged in the upside down configuration.

11. The method of claim 10, further comprising:
coupling a second annular blowout preventer between the first rotating control device and the flow spool.

12. The method of claim 11, further comprising:
coupling a second rotating control device between the first rotating control device and the second annular blowout preventer.

13. The method of claim 9, further comprising:
coupling a second annular blowout preventer between the first rotating control device and the flow spool.

14. The method of claim 13, further comprising:
coupling a second rotating control device between the first rotating control device and the second annular blowout preventer.

15. An integrated riser joint comprising:
a first annular blowout preventer configured to couple to a first riser section;
a first rotating control device coupled to the first annular blowout preventer; and
a flow spool fluidly coupled to the first rotating control device,
wherein the first rotating control device is disposed between the first annular blowout preventer and the flow spool as arranged in a downward order.

16. The integrated riser joint of claim 15, wherein at least one of the first annular blowout preventer or the first rotating control device is arranged in an upside down configuration.

17. The integrated riser joint of claim 16, wherein the other of the first annular blowout preventer and the first rotating control device is arranged in the upside down configuration.

18. The integrated riser joint of claim 16, further comprising:

a second annular blowout preventer coupled between the first rotating control device and the flow spool.

19. The integrated riser joint of claim 18, further comprising:

a second rotating control device coupled between the first rotating control device and the second annular blowout preventer.

20. The integrated riser joint of claim 19, wherein the other of the first annular blowout preventer and the first rotating control device is arranged in the upside down configuration.

* * * * *